US006000634A

United States Patent [19]

Mehoudar

[11] Patent Number: 6,000,634

[45] Date of Patent: Dec. 14, 1999

[54] IRRIGATION SPRINKLER

[75] Inventor: Raphael Mehoudar, Tel Aviv, Israel

[73] Assignee: Hydroplan Engineering LTD., Tel Aviv, Israel

[21] Appl. No.: 09/136,280

[22] Filed: Aug. 20, 1998

[30] Foreign Application Priority Data

Aug. 20, 1997 [IL] Israel ..... 121583

[51] Int. Cl.[6] ..... B05B 3/04

[52] U.S. Cl. ..... 239/222.17; 239/231; 239/533.1; 239/570; 137/504.13; 137/510

[58] Field of Search ..... 239/222.17, 231, 239/533.1, 570; 137/504.13, 510

[56] References Cited

U.S. PATENT DOCUMENTS

| | | | |
|---|---|---|---|
| 4,023,595 | 5/1977 | Zakay | 138/45 |
| 4,209,133 | 6/1980 | Mehoudar | 239/542 |
| 4,593,857 | 6/1986 | Raz | 239/109 |
| 4,702,280 | 10/1987 | Zakai et al. . | |
| 4,760,957 | 8/1988 | Rosenberg | 239/222.17 |
| 4,796,810 | 1/1989 | Zakai . | |
| 4,867,741 | 9/1989 | Portnoy | 137/510 |
| 4,890,639 | 1/1990 | Loliger et al. | 137/510 |
| 4,932,590 | 6/1990 | Hunter | 239/222.17 |
| 4,949,750 | 8/1990 | Goodwin et al. | 137/510 |
| 4,966,328 | 10/1990 | Neeman | 239/524 |
| 5,176,627 | 1/1993 | Watson | 137/510 |
| 5,653,251 | 8/1997 | Handler | 137/114 |

FOREIGN PATENT DOCUMENTS 25 51 655 6/1977 Germany .

*Primary Examiner*—Andres Kashnikow
*Assistant Examiner*—David Deal
*Attorney, Agent, or Firm*—Helfgott & Karas P.C.

[57] ABSTRACT

An irrigation sprinkler having a tubular housing having an inlet and adapted to be coupled to a water supply source and an outlet and in which is located an outlet nozzle including a sprinkler outlet. The housing accommodates flow control means coupled at one end to said inlet end and having an outlet which communicates with and is spaced from the sprinkler outlet by a region defined within the housing and constituting an hydraulic quiet zone for ensuring that water flow arrives at the spray outlet with substantially symmetrical distribution and with minimal turbulence.

12 Claims, 4 Drawing Sheets

IRRIGATION SPRINKLER

FIELD OF THE INVENTION

This invention relates to an irrigation sprinkler and is particularly, but not exclusively, concerned with so-called micro- or mini-sprinklers designed to have a relatively low output flow rate (for example, from 20 to 150 liters per hour).

BACKGROUND OF THE INVENTION

A known problem which arises with such sprinklers, and in particular micro-sprinklers, whether these are of the rotary or of the static kind, is connected with the variation of output rate, spray range and distribution pattern as a consequence of variations in input pressure to the sprinkler, whether these arise as a result of variations in mains supply or as a result of variations in terrain which give rise to differing supply pressures reaching differing sprinklers.

In an attempt to overcome this particular problem, it has been known to associate the water supply to the sprinkler with suitable pressure or flow control means, by which it is desired to ensure that the water reaching the outlet nozzle of the sprinkler is always at a substantially constant outflow rate, irrespective of the supply pressure.

A further problem which arises is associated with sprinklers which are desired to operate at a relatively low output rate. Achieving such a relatively low output rate, and at the same time ensuring that the spray outflow is of sufficient velocity to ensure maintaining an adequate spray range, has involved the use of nozzles with increasingly smaller outflow apertures. It will be readily appreciated that the smaller the outflow aperture, the greater the danger that this aperture becomes blocked by grit and the like.

It is an object of the present invention to provide a new and improved irrigation sprinkler in which some or all of the above-referred-to disadvantages are significantly reduced.

SUMMARY OF THE INVENTION

According to the present invention, there is provided an irrigation sprinkler having a tubular housing; inlet and outlet ends of the housing; an outlet nozzle including a sprinkler outlet fixedly located within the outlet end; a deflector element juxtaposed with respect to said sprinkler outlet; flow control means comprising a base member; first coupling means for sealingly coupling the base member to the housing inlet; second coupling means for coupling the base member to a water supply; a longitudinally directed wall member; transversely directed wall members formed integrally with the longitudinally directed wall member; a recessed portion formed in said longitudinally directed wall member having a rim portion thereof; a resiliently flexible membrane adapted to be held against said rim portion and to define with said recessed portion a flow control chamber; a flow control chamber outlet formed in said recessed portion; said wall portions defining with an internal wall surface of said housing an inlet chamber to which a surface of said membrane remote from said recessed portion is exposed; communicating means for effecting communication between said inlet chamber and said flow control chamber; and a supply inlet formed in said base member for effecting communication between the water supply and said inlet chamber; said sprinkler outlet communicating with and being spaced from said flow control chamber outlet by a region defined within said housing and constituting an hydraulic quiet zone for ensuring that water flow arrives at said sprinkler outlet with substantially symmetrical distribution and with minimal turbulence.

Preferably, the sprinkler outlet is formed so as to ensure contraction of the cross-sectional area of the outflowing jet with respect to the cross-sectional area of a downstream end of the sprinkler outlet. Thus, the sprinkler outlet can be of the sharp-edged, short orifice or sharp-edged re-entrant type. With such sprinkler outlets, ensuring that the water arrives at these outlets with substantially symmetrical distribution and with minimal turbulence carries with it the consequence that the water jet emerging from the outlet is of contracted diameter (i.e. has a diameter less than the diameter of the outlet), and in this way a relatively high velocity outlet jet is achieved without having a sprinkler outlet whose dimensions are so small as to be easily blocked.

The flow control means can be of the differential pressure control type described and forming the subject of our earlier U.S. Pat. No. 4,209,133, to which attention is directed for a full explanation of the mode of operation. As is clearly described in this patent specification, the use of such differential flow control means carries with it, in addition to attaining very effective flow control, the distinct advantage that the flow control means is capable of self-cleaning.

When such flow control means, and in particular differential flow control means, is used in conjunction with the hydraulic quiet zone, additional means are preferably employed, associated with the flow control unit, for ensuring that the water emerging from the flow control unit passes, for example, through a meandering path, thereby inducing into the water flow a preliminary quietening factor.

The particular irrigation sprinkler construction in accordance with the invention can, if desired, be modified for the situation where the flow outlet is not of the sharp-edged short orifice or re-entrant type but, for example of the conical type where the outlet tapers into a downstream direction. With such a modification, the requirements for an hydraulic quiet zone can be minimized.

BRIEF DESCRIPTION OF THE DRAWINGS:

For a better understanding of the present invention, and to show how the same may be carried out in practice, reference will now be made to the accompanying drawings, in which.

DETAILED DESCRIPTION OF A PREFERRED EMBODIMENT

Figure 1:
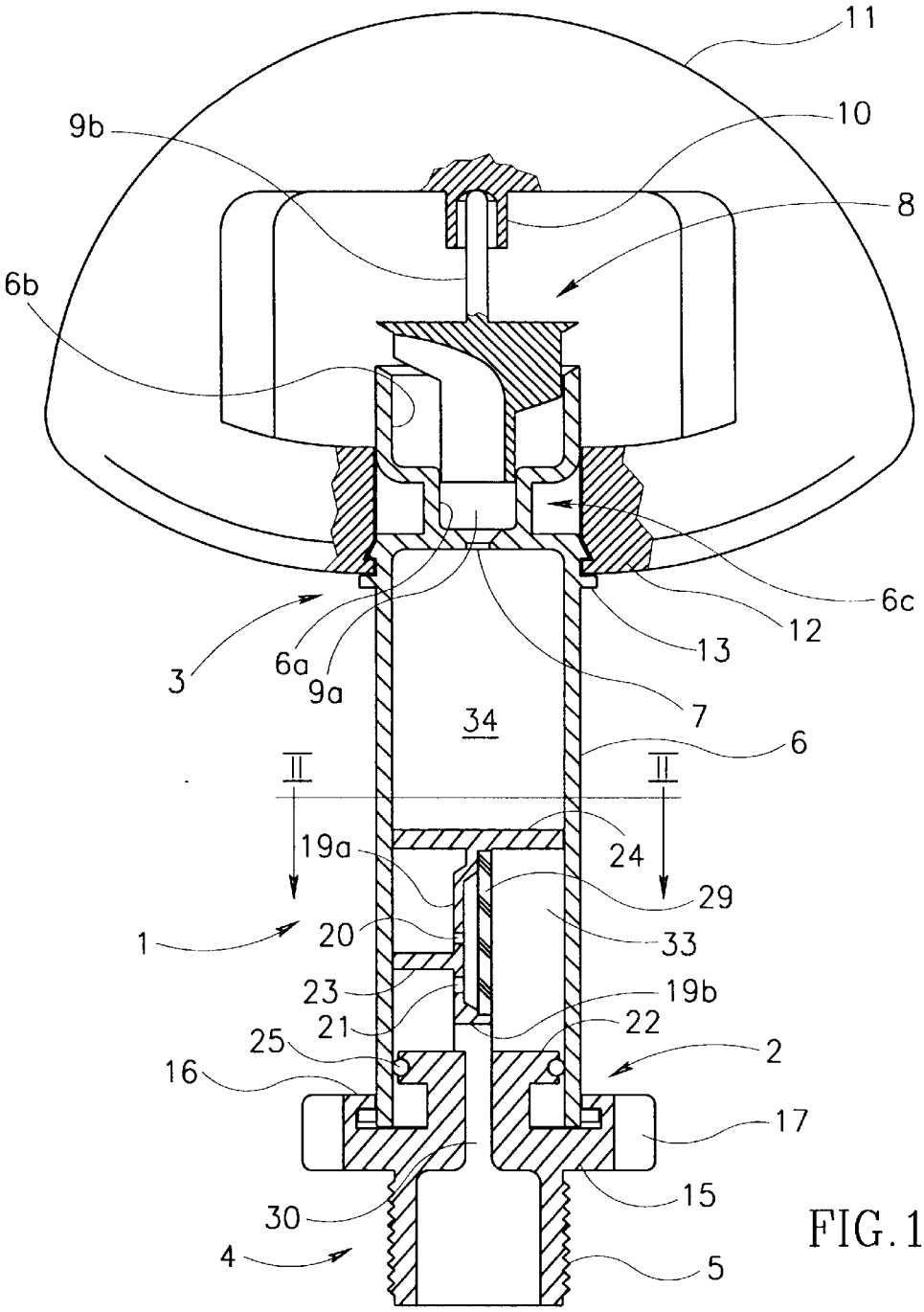
FIG. 1 is a longitudinally sectioned side elevation of a micro-sprinkler in accordance with the present invention.
Figure 2:
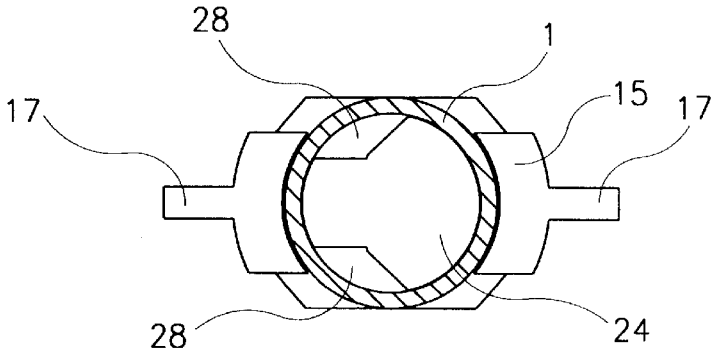
FIG. 2 is a cross-sectional view of the micro-sprinkler shown in FIG. 1 taken along the line II—II.

As seen in FIGS. 1 through 4 of the drawings, a micro-sprinkler in accordance with the present invention comprises a tubular housing 1 having an inlet end 2 and an outlet end 3.

An irrigation flow control unit 4 extends into the tubular housing 1 via the inlet end 2 thereof and is releasably secured thereto and is formed with a screw threaded nipple 5 for coupling to an irrigation water supply (not shown).

Integrally formed in the outlet end 3 of the housing 1 is an annular wall element 6 having a central sprinkler outlet 7. The wall element 6 is formed integrally with a tubular extension 6*a* which, in its turn, is integral with a wider tubular deflector housing 6*b*, the latter being spaced from the wall element 6 by an annular recess 6*c*.

A rotary deflector 8 is located within the deflector housing 6*b* within the bore 7 and is formed with a downwardly directed bearing 9*a* rotatably fitting within the tubular extension 6*a* and with a central, upwardly directed bearing pin 9*b* which is rotatably located in a bearing boss 10 formed integrally with and depending downwardly from a support bridge element 11. The latter has a mounting collar 12 which is mounted on the outlet end 3 of the tubular housing 1 so as to fit around and effectively seal the annular recess 6*c* and so as to rest on a peripheral flange 13 thereof.

In use, the micro-sprinkler is coupled, via the nipple 5, to a supply source (not shown) and water flows into the housing 1 via the flow control unit so as to emerge therefrom and pass out of the sprinkler outlet 7 at an outlet rate which is substantially independent of the supply pressure of the water flowing into the micro-sprinkler. The water flowing out of the sprinkler outlet 7 strikes the rotary deflector 8, causing it to rise and to rotate so as to distribute the water over a substantially circular area whose radius is dependent on the velocity of the outflowing water.

The construction of the deflector 8 and the support bridge 11 is standard and has no bearing on the particular inventive features of the present invention, and therefore will not be described in detail.

Figure 4:
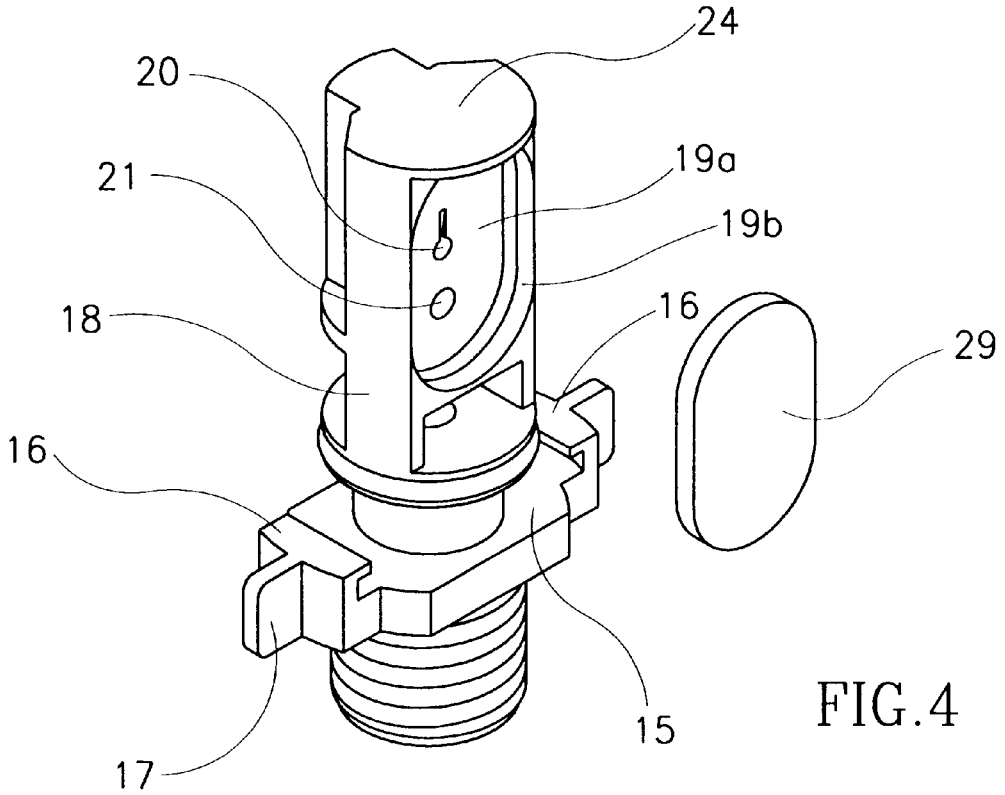
FIG. 4 is an exploded perspective view of a flow control element incorporated in the micro-sprinkler shown in FIG. 1.
Figure 5:
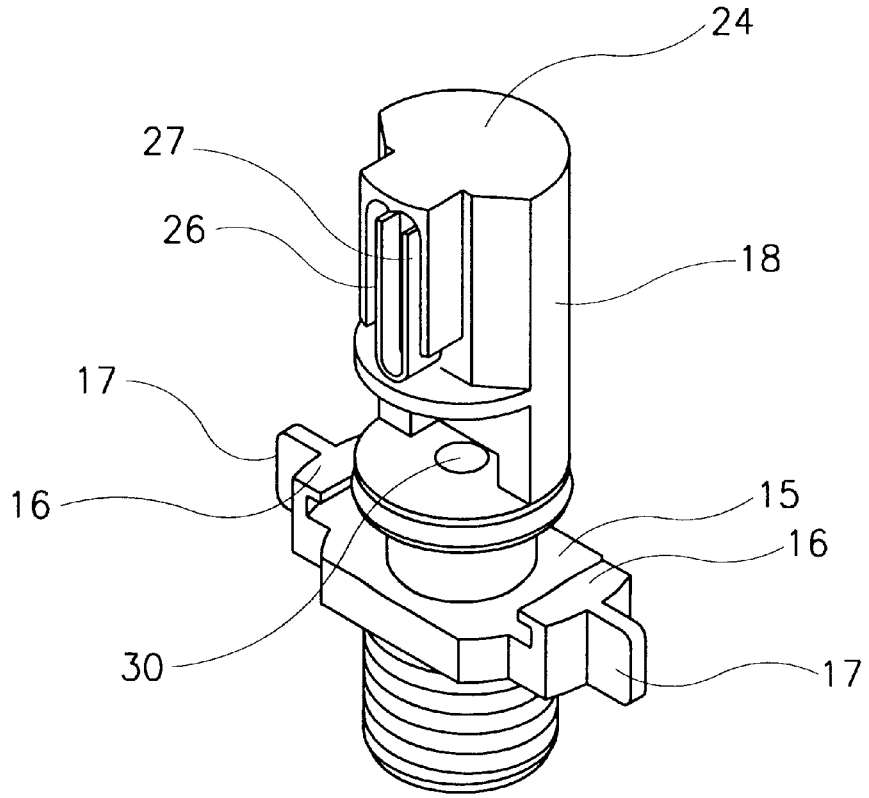
FIG. 5 is a further perspective view of the flow control element shown in FIG. 4, illustrating an opposite side of the element.

Reference will now be made to FIGS. 4 and 5 of the drawings, for a detailed description of the construction of the flow control unit 4. As seen in the Figures, the unit 4 comprises a base element 15 from which depends the inlet nipple 5 and which is formed with a pair of opposite coupling flanges 16 having respectively integrally formed turning wings 17. Formed integrally with the base element 15 and extending upwardly therefrom is a substantially cylindrical casing 18 having a substantially central, longitudinally extending partition wall 19 having a central recessed portion 19*a* which is formed with a throughgoing outlet 20 and, spaced therefrom in a direction towards the base element 15, a throughgoing inlet 21. The recessed portion 19*a* is formed with a rim 19*b*.

The flow control unit 4 is formed with respective lowermost, intermediate and upper transversely directed wall portions 22, 23 and 24, the lowermost wall portion 22 being fitted with an O ring 25.

Extending radially from the casing 18, between the upper wall portion 24 and the intermediate wall portion 23 are a series of laterally directed, longitudinally extending ribs 26 which define, together with the longitudinally extending partition wall 19, a meandering outlet flow channel 27 in communication with the outlet 20.

The ribs 26 extend from a longitudinally extending recessed portion of the cylindrical casing 18, so that there are formed on either side of the ribs 26 flow channels 28 which respectively communicate with the meandering outlet flow channel 27 and therefore with the outlet 20.

Arranged to be fitted within the casing 18 in juxtaposition to the apertures 20 and 21 is a flexible, resilient flow-controlling membrane 29 which is supported against the rim 19*b* so as to be normally retained in a position spaced from the inlet and outlet 20 and 21. The membrane 29 and the recessed portion 19*a* together define a flow control chamber 21.

A throughflow bore 30 is formed in the base element 15 and the lower transverse wall 22.

Figure 3:
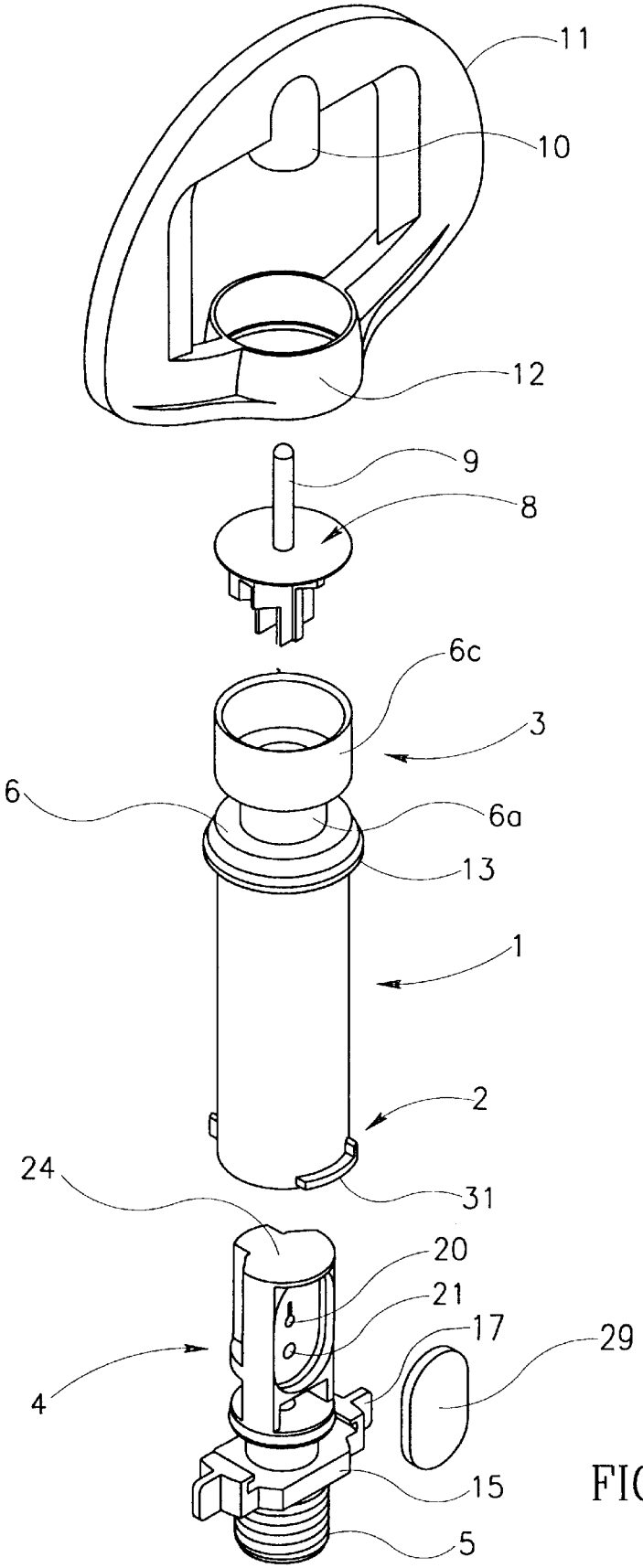
FIG. 3 is an exploded perspective view of the micro-sprinkler shown in FIG. 1.

As can be seen, particularly in FIG. 3 of the drawings, the lowermost inlet end 2 of the tubular housing 1 is formed with a pair of diametrically opposed peripheral coupling flanges 31.

The assembly of the micro-sprinkler takes place with the insertion of the flow control unit 4 into the tubular housing and the bayonet-like coupling of the peripheral coupling flanges 31 within the inwardly-directed coupling flanges 16.

When thus assembled, the transverse walls 22, 23 and 24 sealingly fit against the inner surface of the tubular housing 1, as do the ribs 26. In this way, water flowing through the inlet nipple 5 passes through the bore 30, on the one hand, through an inlet chamber defined between the transverse walls 22 and 23 through the inlet 21 into the flow control chamber 32 and, on the other hand, into an inlet control chamber 33 defined between the membrane 29, the upper and lower transverse walls 22 and 24 and the inner surface of the tubular housing 1.

The provision of the flexible membrane 29 between the outlet and inlet control chambers 32 and 33 results in the exertion of differential pressure control, as a result of which water emerges from the outlet control chamber 32 through the outlet 20 into the meandering outlet flow channel 27 at a substantially constant flow rate.

The passage of the thus flow controlled water flow through the meandering path results in the progressive reduction in the turbulence of this water flow, which eventually passes, via the flow channels 28, into an extended upper zone 34 of the tubular housing defined between the upper transverse wall 24 and the upper annular wall 6 of the housing.

The relative dimensions of this extended upper zone 34 are so chosen as to ensure that this zone serves as an effective, hydraulically quiet zone, wherein any remaining turbulence in the water flow is reduced to a minimum and that the water flowing therein towards the sprinkler outlet 7 reaches it substantially uniformly and symmetrically distributed with respect to the outlet. The flow controlled outflow from the micro-sprinkler emerges from the sprinkler outlet 7, strikes the deflector 8 which in consequence rotates, distributing the outflow over a circular path.

Figure 6A:
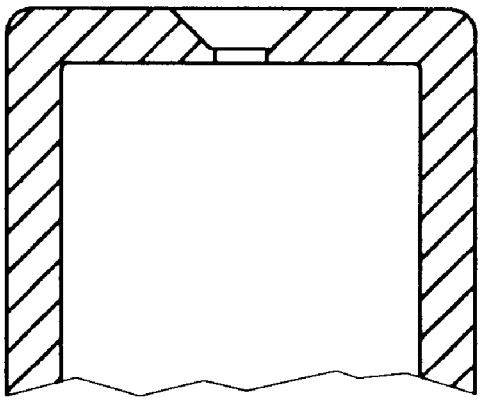
FIGS. 6*a* and 6*b* illustrate schematically respectively differing forms of outlet nozzle mouthpieces for use with micro-sprinklers in accordance with the present invention.
Figure 6B:
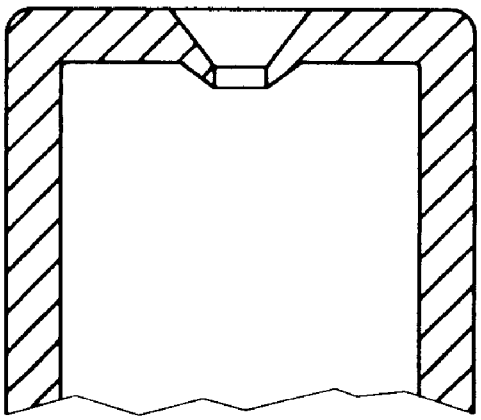

The provision of the micro-sprinkler with an effective hydraulically quiet zone 34, such as that described with respect to the drawings, is of very specific significance when the outlet is formed with a sharp-edged short orifice or re-entrant tube- (Borda) type outlet such as that schematically and respectively illustrated in FIGS. 6*a* and 6*b* of the drawings.

FIG. 6*a* shows an outlet end 3 of the tubular housing 1 having located therein a hydraulically quiet zone 34 and formed with a sharp edged, short orifice 3*a*, whilst FIG. 6*b* shows the outlet end 3 formed with a re-entrant tube-(Borda) type outlet 3*b*.

Thus, the common characteristic of both the orifice and re-entrant tube type outlet is the provision of a very sharp-edged upstream end of the outlet, with the water emerging therefrom undergoing a contraction in transverse dimensions so that the area of the outflowing water flow is less than that of the downstream end of the outlet. By virtue of this contraction, it is ensured that the outflowing spray emerges with sufficient velocity required to achieve an adequate spray range whilst, at the same time, ensuring that the outflow outlet is not of such restricted dimensions as to render it increasingly susceptible to blockage.

Thus, for example, with the orifice-type and re-entrant (Borda) type sprinkler outlets 3*a* and 3*b* as shown in FIGS. 6*a* and 6*b* of the drawings, the cross-sectional area of the outflowing spray can be, for example, between 60–70% of the cross-sectional area of the sharp-edged outlet.

The fact that the area of the nozzle outlet is significantly greater than the cross-sectional area of the spray jet carries with it as a consequence that the aperture can be relatively large and therefore is less susceptible to blockage whilst, at the same time, the spray jet emerges with an adequate velocity to ensure its effective range and distribution. Furthermore, the fact that the emerging jet does not contact the bore walls downstream of the outlet means that these walls are kept relatively free from deposits.

However, as has already been indicated, it is an essential requirement for the effective use of such orifice or re-entrant type outlets, to ensure that water reaching the outlet does so under effectively non-turbulent, symmetrically distributed conditions and for this purpose the provision of the hydraulic quiet zone in the region of the tubular housing adjacent the outlet, is vital.

As has already been indicated, the initial effective reduction in the turbulence of the water flow emerging from the flow control unit is effected by ensuring that the water passes through the meandering outlet channel 27 before emerging into the hydraulic quiet zone 34.

At the same time, the characteristics of the zone 34 so as to ensure that water reaches the orifice or re-entrant type outlet under such substantially non-turbulent and symmetrically arranged disposition, are such that the diameter of the housing portion enclosing the zone 34 should be preferably greater than 3–4 times the diameter of the nozzle outlet, whilst the length of this housing portion should be preferably greater than 10 times the outlet diameter.

In one characteristic example of a micro-sprinkler in accordance with the present invention, the following characteristic dimensions of the sprinkler were employed using a housing wherein the portion thereof enclosing the flow control unit 4 had a diameter of 12 mm whilst the portion thereof enclosing the zone 34 had a reduced diameter of 7 mm and a length of 20 mm. The nozzle outlet orifice had a sharp-edged diameter of 1.4 mm.

It will furthermore be seen that with such a nozzle outlet the sharp edges thereof are upstream and are located within the housing and are therefore not so susceptible to outside-originated damage.

Whilst in the specific embodiment of the invention described above the micro-sprinkler has been illustrated as having a rotary deflector, it will be appreciated that the essential aspect of the micro-sprinkler in accordance with the present invention can equally well be employed with a static type deflector.

Furthermore, whilst the invention has been specifically described for use with a micro-sprinkler having an orifice type or re-entrant type outlet (necessitating, as it does, the provision of a "quiet" zone between the pressure control unit and the outlet), the general micro-sprinkler construction in accordance with the present invention is also applicable in the case wherein the sprinkler outlet is of the converging conical type, in which case, of course, the outgoing spray jet is of a diameter substantially equal to the downstream outlet of the outlet bore, but in this case the requirements for a "quiet" zone between the outlet and the flow control unit can be minimized.

In all cases, the micro-sprinkler construction in accordance with the present invention, consisting as it does of a tubular housing which is releasably and sealingly fitted to the flow control unit (which projects thereinto), ensures the provision of a construction which is capable of very effective and simple sealing with a minimum number of separate parts. Furthermore, the provision of the outlet as an integral portion of the tubular housing, lends itself to ease of production for all types of nozzle outlet servicing, such as cleaning of the nozzle outlet, and cleaning or replacement of the flow control unit can be effected by a simple one-act disassembly of the housing from the flow control unit.

Whilst the invention is equally applicable when flow controlled units, other than those based on differential pressure control, are employed, the use of such differential pressure controlled means is particularly advantageous for all the reasons which have been previously explained in our prior U.S. patent, including the distinct advantage that such differential pressure control is capable of effecting continuous "self-cleaning", thereby significantly minimizing the danger that blockage of the pressure control unit itself takes place.

Furthermore, the provision whereby water enters the flow control chamber 33 via an "orifice" type inlet 21 carries with it the advantages inherent in the use of such "orifices" (as explained above), seeing that the use of an orifice allows for a significantly larger inlet into the flow control chamber, thereby still further minimizing the danger of blockage in this region.

It is furthermore to be noted that the internal construction of the micro-sprinkler does not allow for the collection of stagnant waters when not in use (and thereby minimizes the danger of the production of blocking algae or the like), seeing that water which may be left behind within the tubular housing drains outwardly through the bore 30.

Furthermore, it will already be seen that disassembly of the micro-sprinkler, both for the purpose of cleaning the outlet 7 and the removal and cleaning, or replacement, of the flow control unit 4 can be readily effected by a simple relative rotary motion of the turning wings 17 of the flow control unit 4 with respect to the tubular housing 1.

The fact that the entire micro-sprinkler is effectively and statically sealed with respect to the exterior at a single, readily accessible position (the O-ring 25) is also of distinct advantage in assembly and use.

The use of the O-ring 25 is essentially optional as effective sealing can be effected without it.

It will furthermore be seen that the rotary deflector 8, which is rotatably mounted within the outlet 7 and is upwardly displaced by water pressure during operation, falls back under gravity when water pressure is no longer applied, thereby effectively sealing the upper end of the tubular housing against insects and the like.

I claim:

1. An irrigation sprinkler having a tubular housing; inlet and outlet ends of the housing; an outlet nozzle including a sprinkler outlet fixedly located within the outlet end; a deflector element juxtaposed with respect to said sprinkler outlet; flow control means comprising a base member; first coupling means for sealingly coupling the base member to the housing inlet; second coupling means for coupling the base member to a water supply; a longitudinally directed wall member; transversely directed wall members formed integrally with the longitudinally directed wall member; a recessed portion formed in said longitudinally directed wall member having a rim portion thereof; a resiliently flexible membrane adapted to be held against said rim portion and to define with said recessed portion a flow control chamber; a flow control chamber outlet formed in said recessed portion; said wall portions defining with an internal wall surface of said housing an inlet chamber to which a surface of said membrane remote from said recessed portion is exposed; communicating means for effecting communication between said inlet chamber and said flow control chamber; and a supply inlet formed in said base member for effecting communication between the water supply and said inlet chamber; said sprinkler outlet communicating with and being spaced from said flow control chamber outlet by a region defined within said housing and constituting an hydraulic quiet zone for ensuring that water flow arrives at said sprinkler outlet with substantially symmetrical distribution and with minimal turbulence.

2. A sprinkler according to claim 1, wherein said sprinkler outlet is so formed as to ensure a contraction of the cross-sectional area of an outflowing jet with respect to the cross-sectional area of a downstream end of the sprinkler outlet.

3. A sprinkler according to claim 1, wherein said sprinkler outlet is of the sharp edged, short orifice type.

4. A sprinkler according to claim 1, wherein said spray outlet is of the sharp-edged re-entrant type.

5. A sprinkler according to claim 1, wherein said hydraulic quiet zone has a transverse dimension greater than 3 to 4 times d and a length greater than 10 times d where d is the diameter of the sprinkler outlet.

6. An irrigation sprinkler comprising a tubular housing; inlet and outlet ends of the housing; an outlet nozzle including a sprinkler outlet and fixedly located within said outlet end and flow control means comprising a base member; first coupling means for sealingly coupling the base member to the housing inlet; second coupling means for coupling the base member to a water supply; a longitudinally directed wall member; transversely directed wall members formed integrally with the longitudinally directed wall member; a recessed portion formed in said longitudinally directed wall member having a rim portion thereof, a resiliently flexible membrane adapted to be held against said rim portion and to define with said recessed portion a flow control chamber; a flow control chamber outlet formed in said recessed portion; said wall portions defining with an internal wall surface of said housing an inlet chamber to which a surface of said membrane remote from said recessed portion is exposed; communicating means for effecting communication between said inlet chamber and said flow control chamber; and a supply inlet formed in said base member for effecting communication between the water supply and said inlet chamber; said sprinkler outlet communicating with said flow control chamber outlet.

7. A sprinkler according to claim 6, wherein said sprinkler outlet tapers in an upstream direction.

8. A sprinkler according to claim 6, wherein said flow control means is of the differential pressure flow control type.

9. A sprinkler according to claim 6, wherein said communicating means is restricted.

10. A sprinkler according to claim 6, wherein said restricted communication means is constituted by a sharp edged short orifice formed in said recessed portion.

11. A sprinkler according to claim 6, wherein said first coupling means is constituted by a pair of diametrically opposed, inwardly directed flanges formed on said base member in which they are adapted to be bayonet coupled to a corresponding pair of outwardly directed, diametrically opposed flanges formed adjacent an inlet end of said housing.

12. A sprinkler according to claim 1, wherein said longitudinally directed wall member is furthermore formed with a plurality of laterally directed, longitudinally extending ribs designed to define with an adjacent wall surface of said housing, a meandering path, one end of which communicates with said flow control chamber outlet and an opposite end of which communicates wit said sprinkler outlet.

* * * * *